US005711333A

United States Patent [19]

Vanderminden, Sr.

[11] Patent Number: 5,711,333

[45] Date of Patent: Jan. 27, 1998

[54] UMBRELLA FRAME AND UMBRELLA FOR OUTDOOR FURNITURE

[75] Inventor: Robert D. Vanderminden, Sr., Granville, N.Y.

[73] Assignee: Telescope Casual Furniture Co., Granville, N.Y.

[21] Appl. No.: 788,502

[22] Filed: Jan. 29, 1997

[51] Int. Cl.[6] ..... A45B 25/00; A45B 25/18

[52] U.S. Cl. ..... 135/20.3; 135/98; 135/39; 135/38; 135/20.1; 135/25.33

[58] Field of Search ..... 135/98, 20.1, 20.3, 135/25.33, 26, 28, 30, 38, 39, 41

[56] References Cited

U.S. PATENT DOCUMENTS

| | | | |
|---|---|---|---|
| 534,058 | 2/1895 | Ackermann et al. | 135/98 |
| 1,200,599 | 10/1916 | Erickson | 135/39 |
| 4,011,881 | 3/1977 | Becher | 135/98 X |
| 4,424,824 | 1/1984 | Bercher | 135/20.3 |
| 4,637,415 | 1/1987 | Dalo et al. | 135/98 |
| 4,813,442 | 3/1989 | Haines | 135/98 |
| 4,878,509 | 11/1989 | Tung | 135/98 X |
| 5,152,495 | 10/1992 | Jacinto et al. | 135/98 X |
| 5,361,792 | 11/1994 | Lin et al. | 135/38 X |
| 5,437,297 | 8/1995 | Crisman | 135/20.3 X |
| 5,441,065 | 8/1995 | Lin et al. | 135/20.3 X |

*Primary Examiner*—Wynn E. Wood

*Attorney, Agent, or Firm*—McAulay Fisher Nissen Goldberg & Kiel, LLP

[57] ABSTRACT

The umbrella frame is provided with a movable yoke at the upper end and a stationary yoke at an intermediate point. Ribs are pivotally mounted on the movable yoke and struts are pivotally mounted on the fixed yoke while being pivotally mounted to intermediate points on the ribs. A downward movement of the upper yoke causes the ribs to splay outwardly so as to open the umbrella. A crank mechanism is connected to the upper yoke via a cord so that upon cranking of the crank mechanism in one direction, the upper yoke is pulled downwardly to open the umbrella. A clutch assembly is also provided in the crank assembly to lock the crank assembly against the weight of the ribs and cover while allowing a reverse rotation of the crank mechanism under a manually applied force to permit the umbrella to close under the weight of the ribs and cover.

21 Claims, 4 Drawing Sheets

FIG. 5
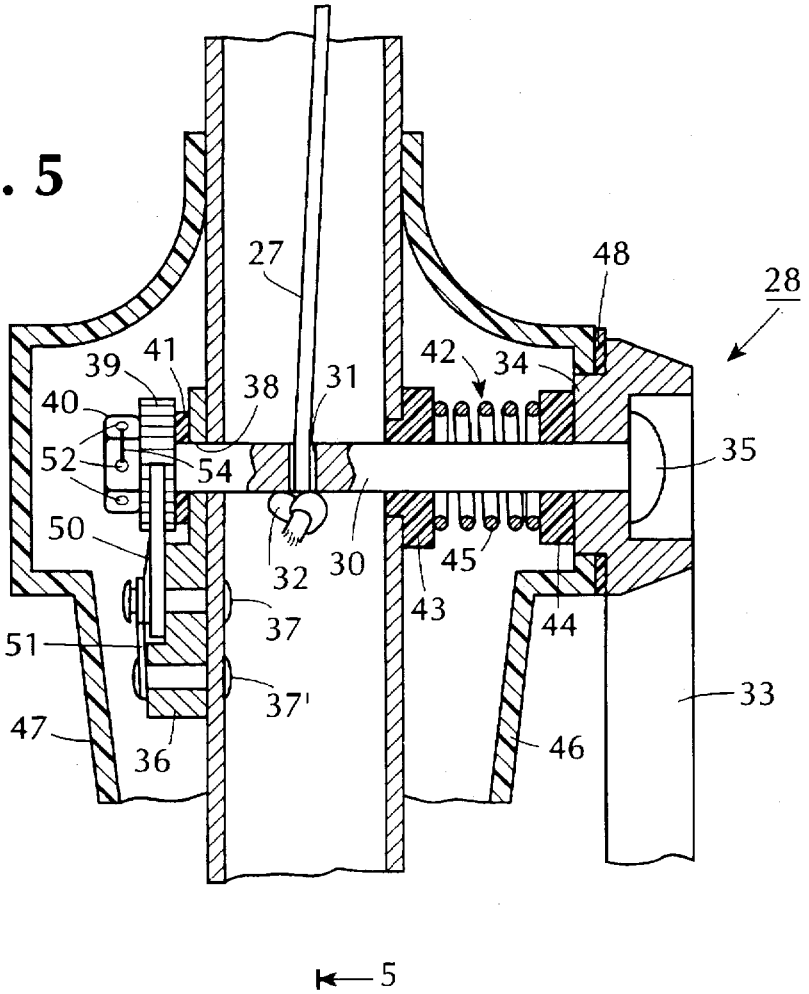
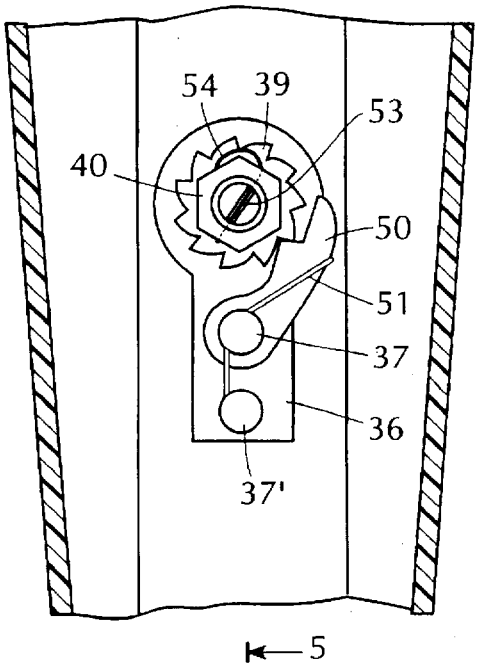
FIG. 4

UMBRELLA FRAME AND UMBRELLA FOR OUTDOOR FURNITURE

This invention relates to an umbrella frame and to an umbrella for outdoor furniture.

As is known, various types of umbrella frames have been used for making umbrellas suitable for outdoor use. For example, a typical umbrella has been constructed with a vertical pole on which a yoke assembly is fixed near the top of the pole and provided with radiating ribs which can be directed outwardly of the pole or collapsed toward the pole by an actuating mechanism. Generally, such an actuating mechanism employs a second yoke which is movable vertically along the pole and struts which connect the movable yoke to the ribs. Suitable crank assemblies have also been provided to crank the movable yoke from a rest position to a raised position in order to cause the struts to splay the ribs attached to the upper fixed yoke upwardly and outwardly. These crank assemblies have employed a cord to lift the movable yoke by securing one end of the cord to the crank mechanism and the opposite end to the movable yoke after passing over a pulley located near the top of the pole. Thus, cranking of the crank assembly allows the movable yoke to be pulled upwardly along the pole via the cord when the umbrella is to be opened.

In the past, umbrella constructions of the above type have been relatively cumbersome to use for outdoor use, particularly for the raising and lowering of a cover attached to the radiating ribs.

Further, the known umbrella constructions have typically had the umbrella cover secured not only to the ends of the ribs but also to intermediate points of the ribs. As a result, when in a fully open position, the umbrella cover takes on a segmented pie-shaped configuration rather than a smooth draped appearance. Still further, since the covers have been attached at a multiplicity of points to the ribs of the umbrella frame, removal of the covers for replacement or cleaning purposes should the covers become torn or soiled over a period of use has been difficult.

Accordingly, it is an object of the invention to provide an improved umbrella frame construction to simplify the raising and lowering of a cover.

It is another object of the invention to be able to readily remove a cover from an umbrella for replacement or cleaning purposes.

It is another object of the invention to reduce the time required to raise the cover of an umbrella to a fully opened position.

Briefly, the invention provides an umbrella frame which has a hollow pole, a first yoke fixedly mounted on the pole, a second yoke which is movably mounted on the pole above the fixed yoke and means for moving the second yoke along the pole between a remote raised position and a distal lowered position relative to the fixed yoke. In addition, the umbrella frame has a plurality of radially disposed ribs, each of which is pivotally connected at one end to the movable yoke to move therewith as well as a plurality of radially disposed struts each of which is pivotally connected at one end to the fixed yoke while also being pivotally connected at an opposite end to an intermediate point of a respective one of the ribs. The ribs and struts are interconnected so that the struts cause the ribs to splay outwardly of the pole in response to movement of the movable yoke to the distal position, i.e. the lowered position. The struts also cause the movable yoke to move to the remote position, i.e. the raised position.

The means for moving the movable yoke between the raised position and the lowered position includes a cord and a crank assembly. The cord has one end engaging the movable yoke, for example being passed through an opening in the yoke and being provided with a knot or equivalent at the free end to abut the top of the yoke. The crank assembly is located below the yokes and engages an opposite end of the cord in order to wind the cord thereon. Thus, winding of the cord onto the crank assembly pulls the movable yoke from the raised position to the lowered position.

In accordance with the invention, the crank assembly includes a bolt or shaft which is rotatably mounted in the pole on an axis perpendicular to the pole and is engaged with the cord in a manner to permit winding up of the cord on the bolt in response to rotation of the bolt. In addition, a crank arm is secured to the bolt outside of the pole for rotating the bolt in order to wind up the cord thereon.

The crank assembly further includes a friction clutch assembly mounted on the pole to permit rotation of the bolt with the crank arm in one direction in response to a manually applied force while preventing rotation of the bolt and the crank arm in the opposite direction in the absence of a manually applied force on the crank arm. This clutch assembly includes a ratchet wheel rotatably mounted on the bolt, a spring biased means for frictionally engaging the ratchet wheel with the bolt and a spring-biased pawl for engaging the ratchet wheel. The spring biased means creates sufficient force on the ratchet wheel to lock the ratchet wheel to the bolt to rotate with the bolt in one direction.

The spring-biased pawl engages with the ratchet wheel to prevent rotation of the ratchet wheel and the bolt in an opposite direction in the absence of a manually applied force on the crank arm. Thus, when the bolt is rotated by the crank arm, the pawl allows the ratchet wheel to rotate with the bolt. However, once a manually applied force is removed from the crank arm, the bolt is restrained from rotating in a reverse direction due to the engagement of the pawl with the ratchet wheel and the friction engagement of the ratchet wheel with the bolt via the clutch assembly.

Since the weight of the ribs and a cover on the ribs tend to cause collapse of the ribs inwardly toward the pole, the friction force generated by the friction clutch assembly to lock the ratchet wheel to the bolt must be sufficient to prevent the weight of the ribs and cover from collapsing the ribs toward the pole.

The spring-biased means of the clutch assembly includes a nut which is secured to one end of the bolt and which abuts the ratchet wheel, a washer which is slidably mounted on the bolt and which abuts the ratchet wheel on a side opposite the nut and a spring unit biasing the nut against the ratchet wheel and the washer to impose a friction force on the ratchet wheel sufficient to allow the ratchet wheel to rotate with the bolt during winding up of the cord on the bolt, i.e. during raising of the ribs, and to prevent rotation of the bolt under the gravitational forces of the ribs and cover which are imposed on the cord. In this respect, the friction force is at least equal to the gravitational force imposed on the cord by the ribs and cover tending to collapse inwardly under gravity towards the pole from an outwardly splayed position.

The spring unit includes a grommet which is mounted in the pole on a side opposite from the ratchet wheel, a washer disposed about the bolt and abutted against a hub of the crank arm and a compression spring about the bolt which is compressed between the grommet and the washer. The compression spring thus serves to exert a biasing force on the washer and, in turn, the crank arm and the bolt so as to bias the nut on the opposite end of the bolt against the ratchet wheel to impose the friction force on the ratchet wheel which is described above.

The umbrella frame also has a housing having a first half-piece mounted on the crank arm over the spring unit and crank arm and a second half-piece which is disposed on an opposite side of the pole. This second half-piece is secured to the first half-piece to house the clutch assembly therein.

The cover which is provided for the umbrella frame can be removed from time to time for cleaning and/or replacement purposes. To this end, the cover is removably mounted at a central area on the top of the pole and is removably secured at a plurality of peripherally disposed points to the ends of the ribs. When the ribs are in the outwardly splayed position, the cover is spaced from the ribs. This gives the umbrella a clean sloping appearance rather than a segmented "pie" look that results when a cover is stretched over the ribs. Further, spacing the cover from the ribs in the splayed out position of the ribs prevents the cover from wearing due to contact with the ribs and hardware during windy conditions.

These and other objects and advantages of the invention will become more apparent from the following detailed description taken in conjunction with the accompanying drawings wherein:

FIG. 4 illustrates a cross-sectional view of a portion of the crank assembly constructed in accordance with the invention; and FIG. 5 illustrates a view taken on line 5—5 of FIG. 4 of the crank assembly.

Figure 1:
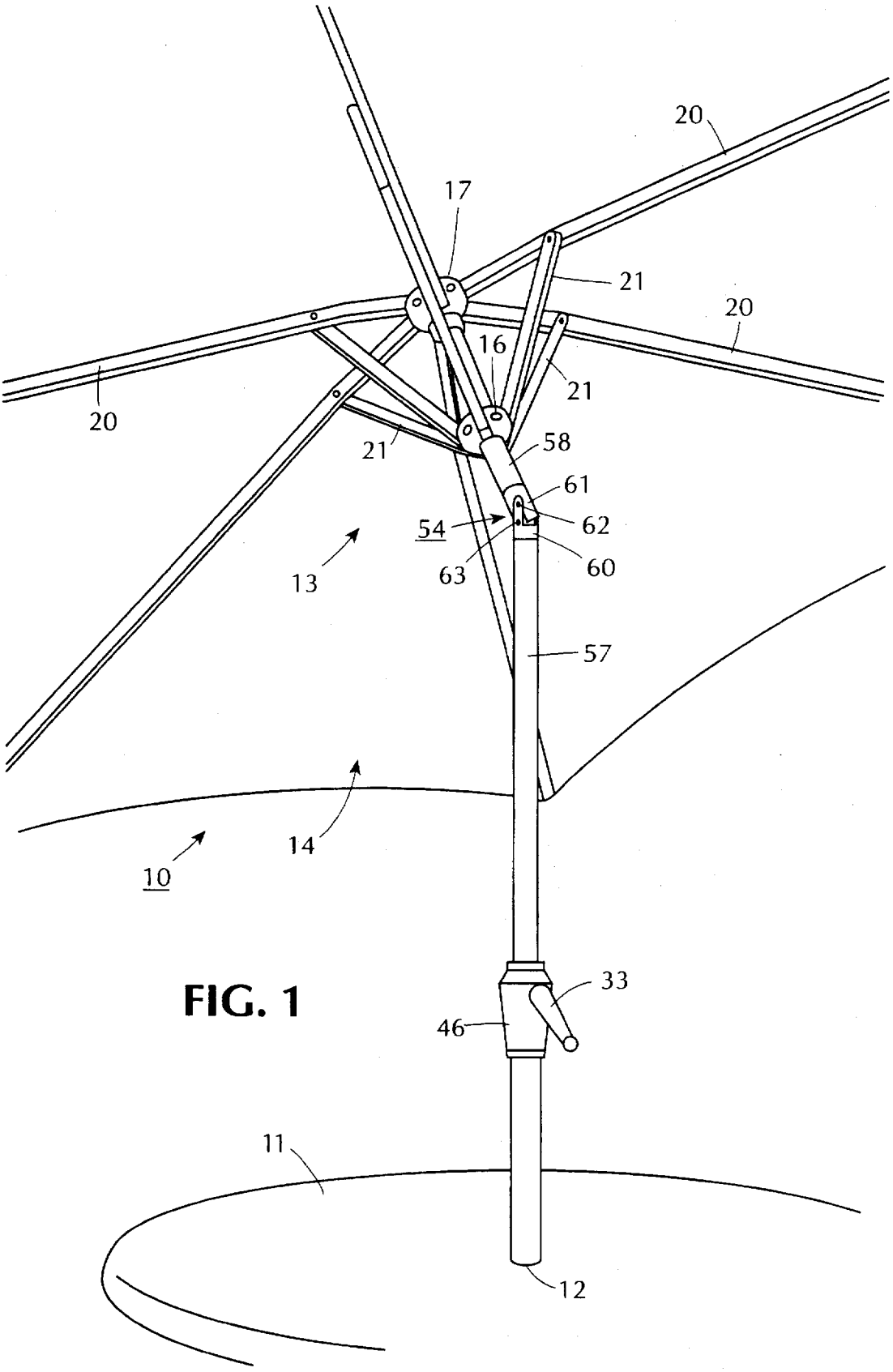
FIG. 1 illustrates a prespective view of an umbrella constructed in accordance with the invention in a tilted position in association with an outdoor table.

Referring to FIG. 1, the umbrella 10 is constructed and sized for use with outdoor furniture, particularly a table 11 having an aperture 12 in a center region to receive the umbrella 10. Such a use is conventional and need not be further described.

As indicated in FIG. 1, the umbrella 10 is formed of a frame 13 and a cover 14 as more particularly described below.

Figure 2:
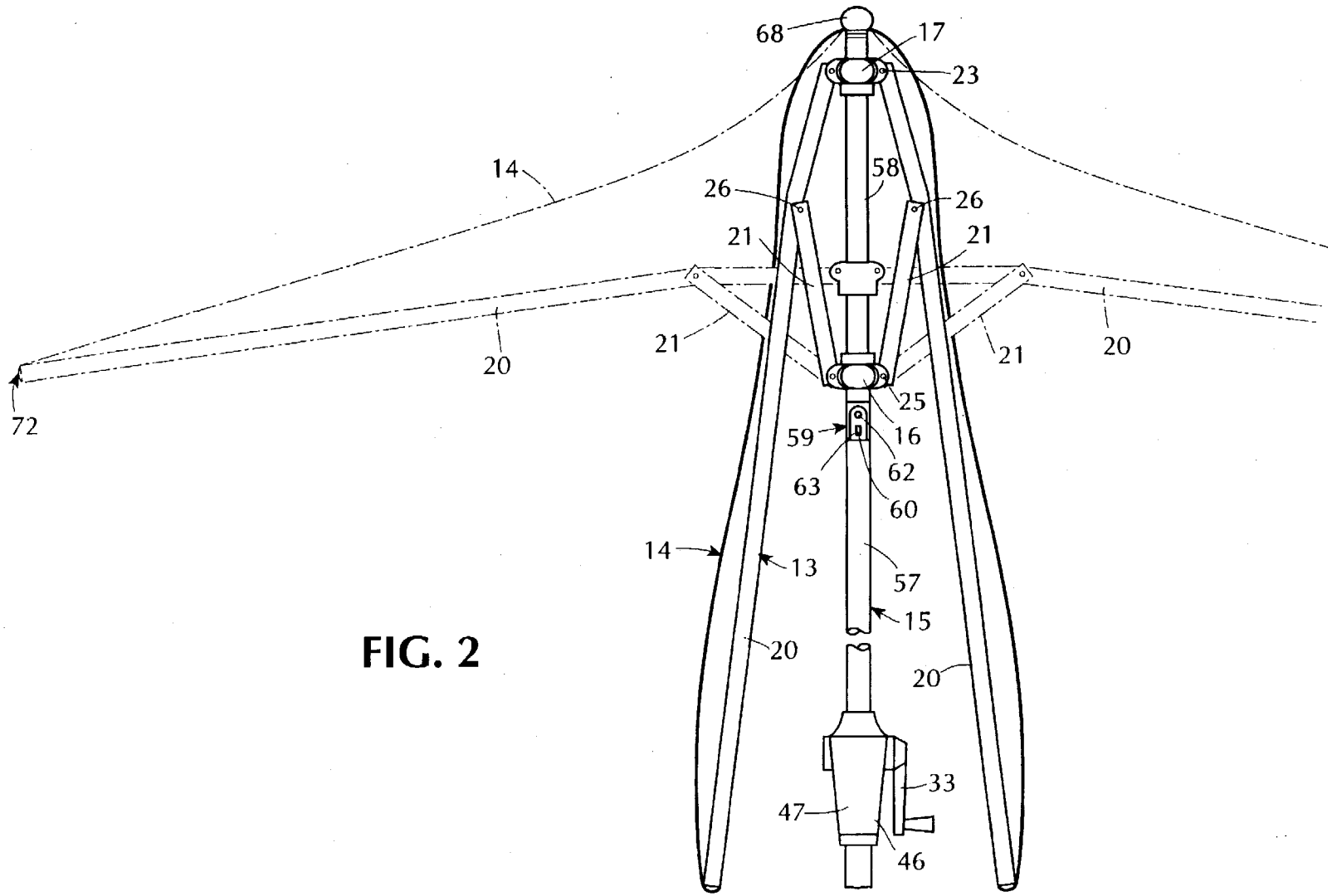
FIG. 2 illustrates a part cross-sectional view of the umbrella of FIG. 1 in a collapsed position in solid line and in an opened position in dotted line.
Figure 3:
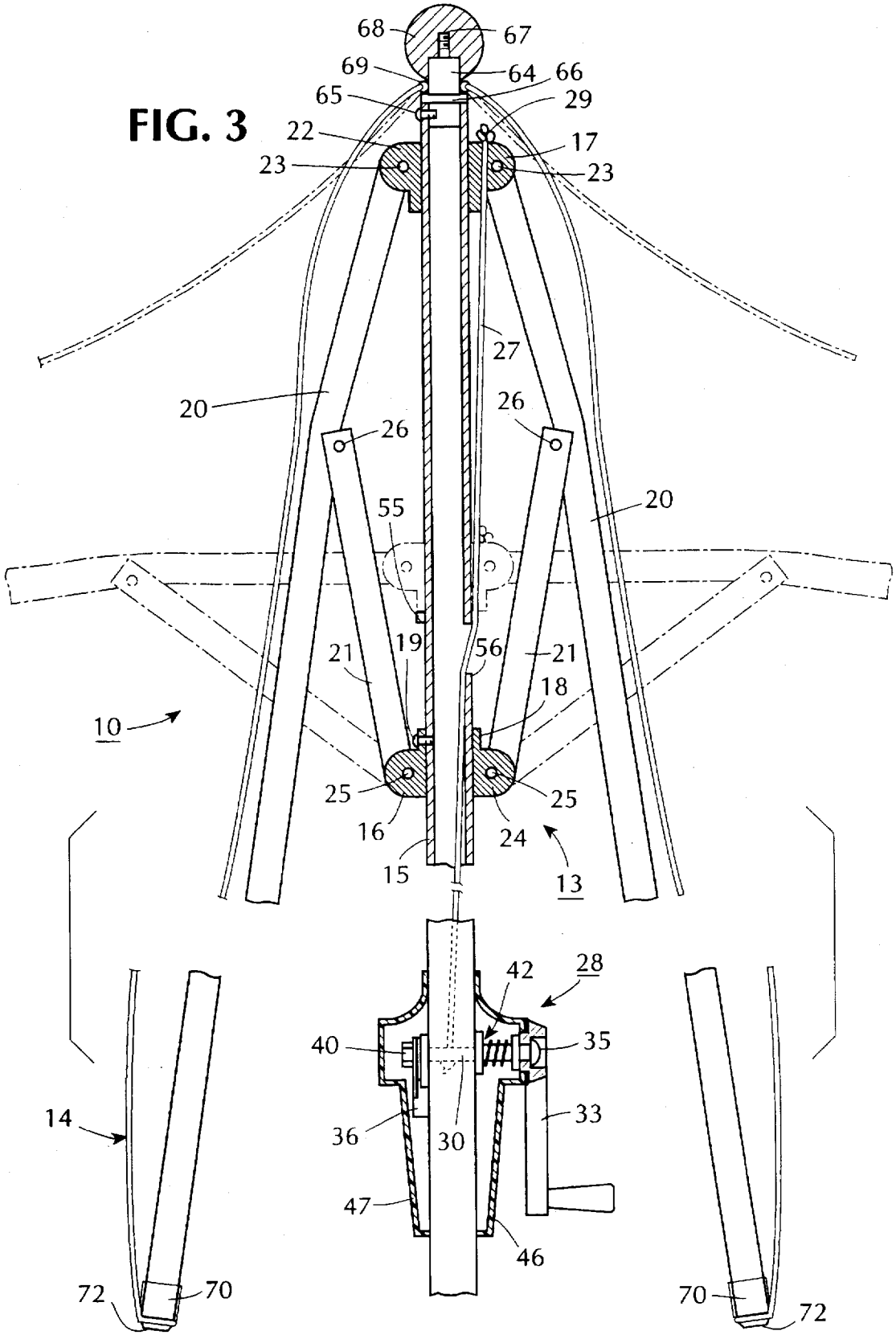
FIG. 3 illustrates a cross-sectional view of the umbrella with the collapsed position of the cover shown in solid line and the opened position of the cover shown in dotted line.

Referring to FIGS. 2 and 3, the umbrella frame 13 includes a hollow pole 15 which is to be vertically mounted, a first yoke 16 which is fixedly mounted on the pole 15 and a second yoke 17 which is movably mounted on the pole 15 above the fixed yoke 16 to move relative to the fixed yoke 16 between a raised position remote from the fixed yoke 16 and a lowered position distal of the fixed yoke 16 (shown in dotted line).

As indicated in FIG. 3, the fixed yoke 16 has a cylindrical collar 18 which is secured to the hollow pole 15 via a screw 19 which is passed through the collar 18 into threaded engagement with the pole 15. The upper movable yoke 17 is of similar construction but is not secured to the pole 15.

A plurality of radially disposed ribs 20 are pivotally connected at one end to the movable yoke 17 while a plurality of radially disposed struts 21 are pivotally connected at one end to the fixed yoke 16 and at the opposite ends to intermediate points of the ribs 20. Each rib 20 is of hollow rectangular cross-section and is made, for example of aluminum. Each rib 20 also has an upper end pivotally secured within a slot 22 in the movable yoke 17 by means of a pivot 23 in the form of a threaded screw. For example, the screw 23 has a threaded shank passing through a shouldered part of the yoke 17 and through the rib 20 into threaded engagement with a side wall of the slot 22 while a head of the screw 23 abuts against the shouldered part of the yoke 17. In this way, removal of the screw 23 would permit replacement of a rib 20 if required. Alternatively, a fixed pin arrangement may be used to pivotally mount the end of the rib 20 in the yoke 17.

Each strut 21 is of hollow rectangular cross-section and is made of aluminum. Each strut 21 also has a lower end pivotally secured within a slot 24 of the fixed yoke 16 by a pivot, such as a screw 25, in a manner as described above with respect to the mounting of a rib 20 in the movable yoke 17.

The opposite end of each strut 21 is also pivotally connected to a respective rib 20 in side-by-side relation by a pivot pin 26 which passes through a respective strut 21 and rib 20.

The articulation of the ribs 20 and struts 21 to the yokes 16, 17 is such that when the movable yoke 17 is moved from the raised position shown in solid line in FIG. 2 to the lowered position shown in dotted line in FIG. 2, the ribs 20 move from the collapsed position shown in solid line in FIG. 2 to the outwardly splayed position indicated by dotted line in FIG. 2.

Referring to FIG. 3, the umbrella 10 also has a means for moving the movable yoke 17 along the pole 15 between the raised (remote) position and the lowered (distal) position relative to the fixed yoke 16. This means includes a cord 27 and a crank assembly 28 for winding of the cord 27. As shown, the cord 27 passes through the movable yoke 17 and is provided with a knot 29 or the equivalent at the end to engage with the top surface of the movable yoke 17. The crank assembly 28 engages the opposite end of the cord 27 to wind the cord 27 thereon. Thus, winding of the cord 27 onto the crank assembly 28 pulls the movable yoke 17 downwardly from the raised position shown in solid line in FIG. 3 to the lowered position shown in dotted line in FIG. 3.

Referring to FIGS. 4 and 5, the crank assembly 28 includes a bolt 30 which is rotatably mounted in the pole 15 on an axis perpendicular to the pole 15 and has an aperture 31 through which the cord 27 passes. As indicated, the end of the cord 27 has a knot 32 or the equivalent for engaging against the underside of the bolt 30.

A crank arm 33 is mounted on the bolt 30 outside of the pole 15 for rotating the bolt 30 in order to wind up the cord 27 when desired. To this end, the crank arm 33 has a hub 34 with a bore which mates with a cross-section of the bolt 30, e.g. a square cross-section, to allow the bolt 30 to rotate with the crank arm 33. This crank arm 33 is of any conventional structure while the bolt 30 has a head 35 abutting and recessed within the hub 34 of the crank arm 33.

The crank assembly 28 also includes a friction clutch assembly which permits rotation of the bolt 30 in response to manual rotation of the crank arm 33 in one direction to pull down the movable yoke 17 (see FIG. 3) and raise the ribs 20 but prevents rotation of the bolt 30 and the crank arm 33 in the opposite direction in the absence of a manually applied rotating force on the crank arm 33 against the gravitational force of the ribs 20 and cover 14. The clutch assembly includes a mounting block 36 which is secured to the pole 15 by means of two rivets 37, 37'. As indicated in FIG. 5, the mounting block 36 has an aperture 38 through which the bolt 30 passes in relatively rotatable relation. The clutch assembly also has a ratchet wheel 39 which is mounted on the bolt 30 in a relatively rotatable manner and a spring-biased means for frictionally engaging the ratchet wheel 39 with the bolt 30 to rotate with the bolt 30. This spring-biased means includes a nut 40 threaded onto the bolt 30 to abut one side of the ratchet wheel 39, a washer 41 mounted on the bolt 30 between the mounting block 36 and ratchet wheel 39 to abut the opposite side of the ratchet wheel 39 from the nut 40 and a spring unit 42 disposed on an opposite side of the pole 15 from the ratchet wheel 39 to bias the nut 40 against the ratchet wheel 39 and the washer 41 in order to impose a friction force on the ratchet wheel 39. In this respect, the friction force imposed on the ratchet wheel 39 by being sandwiched between the nut 40 and washer 41 is at least equal to the gravitational force imposed by the ribs 20 and the cover 14 on the cord 27 due to the tendency of the ribs 20 to collapse inwardly towards the pole 15 from an outwardly splayed position.

The spring unit 42 includes a grommet 43 which is fixed in an aperture of the pole 15, a washer 44 which is mounted on the bolt 30 to abut the hub 34 of the crank arm 33 and a compression spring 45 which is disposed about the bolt 30 and is compressed between the grommet 43 and the washer 44.

As indicated in FIG. 5, a first half-piece 46 of a housing is slidably mounted on the hub 34 of the crank arm 33 while a second half-piece 47 of the housing is disposed on an opposite side of the pole 15. The two half-pieces 46, 47 are secured together, as by screws (not shown), in order to house the clutch assembly in a sealed manner.

As shown in FIG. 5, a thin plastic washer 48 is disposed between the housing half 46 and the crank arm 33 to reduce friction therebetween.

Referring to FIGS. 4 and 5, the clutch assembly also has a pawl 50 pivotally mounted on a rivet 37 and is biased by a spring 51 mounted on the rivet 37 to engage with the ratchet wheel 39 to prevent reverse rotation. In the absence of a manually applied force on the crank arm 33 and with the cord 27 wound onto the bolt 30, the pawl 50 prevents the ratchet wheel 39 from a backward rotation, e.g. clockwise as viewed in FIG. 4. Thus, in view of the friction engagement of the ratchet wheel 39 with the bolt 30, the bolt 30 is prevented from unwinding the cord 27. However, should the crank arm 33 be turned manually in the reverse direction, the bolt 30 is caused to slip relative to the fixed in place ratchet wheel 39 thereby unwinding the cord 27. The raised ribs 20 are now able to pivot downwardly under gravity while causing the movable yoke 17 to ride up the pole 15. As shown in FIG. 5, the nut 42 is provided with an aperture 52 in each face while the bolt 30 is provided with a transverse slot 53 in the end as shown in FIG. 4. In addition, a wire 54 is passed through two oppositely aligned apertures 52 of the nut 42 which are aligned with the slot 53 in the bolt 30 in order to lock the nut 42 against rotation relative to the bolt 30. One end of the wire 54 is also bent around in the manner of a cotter pin and inserted in another aperture 52 of the nut 42 which is not aligned with the slot 53 in the bolt 30 to retain the wire 54 in place.

Referring to FIG. 3, a stop 55 is provided on the pole 15 for abutting the movable yoke 17 in the lowered position.

Referring to FIG. 3, the pole 15 has a slot 56 which permits passage of the cord 27. In addition, as indicated in FIG. 2, the pole 15 has two coaxial portions 57, 58 which are articulated together by a tilt mechanism 59 so that the upper portion 58 can be tilted into a selected one of several angular positions, relative to the lower portion 57, for example as shown in FIG. 1. In this respect, the tilt mechanism 59 includes a bifurcated piece 60 mounted on the fixed lower pole portion 57 and a stem 61 mounted on the lower end of the upper tiltable portion 58. The stem 61 is pivotally mounted via a pivot pin 62 in the bifurcated piece 60 and a manually operated slide lock 63 of conventional structure is provided to lock the stem 61 in one of three positions relative to the bifurcated piece 60. For example, the lock 63 includes a detent (not shown) which is able to fit into one of three slots (not shown) in the stem 61. One slot is disposed centrally of the stem 61 to align the upper portion 58 with the lower portion 57; a second slot is provided to the left of the central slot to permit tilting of the upper portion 58 to one side relative to the lower portion 57; and the third slot is similarly located to the opposite side of the central slot.

Referring to FIG. 3, the upper end of the pole 15 is provided with a post 64 of solid construction which has a depending portion located within the pole 15 and which is secured in place by a threaded screw 65. In addition, the post 64 has an annular shoulder 66 which abuts the top of the pole 15 while a threaded pin 67 extends upwardly from a central portion of the post 64. A decorative retaining knob 68 is threaded onto the pin 67 for purposes as described below.

As shown in FIG. 3, the cover 14 has a ring 69, for example of metal, in a central area which is concentrically mounted on the post 64 to rest on the shoulder 66. As illustrated, the ring 69 is held on the post 64 by the retaining knob 68.

The cover 14 is made of any suitable material, such as cloth, and is secured at a plurality of peripherally disposed points to the ribs 20 of the umbrella frame. As indicated in FIG. 3, snap fastener elements are used to secure the periphery of the cover 14 to ends of the ribs 20. For example, the end of each rib 20 is provided with a plastic cap 70 at the end on which a male snap fastener element 71 is mounted while the cover 14 is provided with a female snap fastener element 72 to snap fit over the male snap fastener element 71.

In use, after the umbrella 10 has been mounted in place relative to the table 11 as indicated in FIG. 1, the user may crank the arm 33 of the crank assembly 28, for example in a clockwise direction so as to wind up the cord 27 (not shown) on the bolt 30 thereby pulling the movable yoke 17 downwardly. At this time, the ratchet wheel 39 of the clutch assembly (see FIGS. 4 and 5) rotates with the bolt 30 while the pawl 50 prevents a reverse rotation of the ratchet wheel 39. As the movable yoke 17 moves downwardly into the lowered position established by the stop 55, the ribs 20 move from the collapsed position indicated in solid line in FIG. 2 to the outwardly splayed position illustrated in FIG. 2. As indicated in FIG. 2, the cover 14 is then spaced from the ribs 20 since the central portion is mounted via the ring 69 on the post 64 and the periphery of the cover 14 is secured to the free ends of the ribs 20. That is to say, the cover 14 is not attached to the ribs 20 except for peripheral attachment of the cover 14 to the free ends of the ribs 20. Thus, the cover 14 is given a clean sloping appearance rather than a segmented pie look that results when a cover is otherwise stretched over the ribs. This feature also keeps the cover 14 from wearing due to contact with the ribs 20 and hardware during windy conditions.

The distance traveled by the movable yoke 17 to open the umbrella is less than in a typical umbrella. This makes for less cranks to open the umbrella.

Since the upper yoke 17 is being pulled down rather than the lower yoke 16 being pulled up, actuation requires a straight pull on the cord 27 towards the crank assembly 28. This eliminates any need for a pulley at the upper end of the pole to change the direction as is required in a typical umbrella design.

In order to close the umbrella, the crank arm 33 is rotated in a counter-clockwise manner. At this time, the pawl 50 which engages with the ratchet wheel 39 prevents rotation of the ratchet wheel 39 with the crank arm 33 and bolt 30. As the bolt 30 rotates, a degree of slack is provided in the cord 27 which is then taken up by a corresponding downward movement of the ribs 20 and the cover 14 under gravity. The ribs 20 thus collapse into a collapsed position, for example as indicated in solid line in FIG. 2 causing the movable yoke 17 to ride upwardly on the post 15. At the same time, the cover 14 drapes about the ribs 20 while loosening. Thus, when the umbrella is in the down position, the cover 14 is not under tension. This allows for easy removal of the cover 14, for example for cleaning purposes.

In order to remove the cover 14, the female snap fastener elements 72 are removed from the male snap fastener elements 71 manually. At the same time, the retaining knob 68 is threaded off the top of the pole 15 and the ring 69 lifted off the post 64. The cover 14 is then completely detached from the umbrella frame and can be removed for cleaning purposes. In order to remount the cover 14 in place, a reverse procedure is followed.

The invention thus provides an umbrella of relatively simple construction which can be quickly opened with a minimum of crank turns. For example, the unique quick lift crank assembly allows the umbrella to be extended from the collapsed position to the outwardly splayed position in six cranks as compared to a conventional outdoor umbrella of similar size which would require eighteen to twenty cranks to achieve the same result.

The ribs 20 may be made of any suitable shape. However, in the described embodiment, each rib has a hollow rectangular cross-section. In addition, the ribs may be made of any suitable material. In the described embodiment, the ribs 20 are made of aluminum. Likewise, the pole and struts 21 are made of aluminum. The yokes 16, 17 are preferably made of a suitable plastic while the pole 15 is a powder coated aluminum so that the material of the yokes 16, 17 will not leave any rub marks on the pole 15.

What is claimed is:

1. An umbrella frame comprising an pole;

a first yoke fixedly mounted on said pole;

a second yoke movably mounted on said pole above said first yoke;

means for moving said second yoke along said pole between a remote position and a distal position relative to said first yoke;

a plurality of radially disposed ribs, each rib being pivotally connected at one end to said second yoke to move therewith; and a plurality of radially disposed struts, each strut being pivotally connected at one end to said first yoke and being pivotally connected at an opposite end to a respective one of said ribs whereby said struts cause said ribs to splay outwardly of said pole in response to movement of said second yoke to said distal position and said struts cause said second yoke to move towards said remote position in response to collapsing of said ribs inwardly under gravity.

2. An umbrella frame as set forth in claim 1 wherein said means for moving said second yoke includes a cord having one end engaging said second yoke and a crank assembly engaging an opposite end of said cord to wind said cord thereon whereby winding of said cord onto said crank assembly pulls said second yoke from said remote position to said distal position.

3. An umbrella frame as set forth in claim 2 wherein said crank assembly includes a bolt rotatably mounted in said pole on an axis perpendicular to said pole with said opposite end of said cord engaged therewith and a crank arm secured to said bolt outside said pole for rotating said bolt to wind up said cord thereon.

4. An umbrella frame as set forth in claim 3 wherein said crank assembly further includes a friction clutch assembly mounted on said pole to permit rotation of said bolt with said crank arm in one direction and while preventing rotation of said bolt and said crank arm in an opposite direction in the absence of a manually applied force on said crank arm.

5. An umbrella frame as set forth in claim 4 wherein said clutch assembly includes a ratchet wheel mounted on said bolt, spring biased means for frictionally engaging said ratchet wheel with said bolt to rotate therewith and a spring biased pawl engaging with said ratchet wheel to prevent rotation of said ratchet wheel with said bolt in an opposite direction.

6. An umbrella frame as set forth in claim 5 wherein said spring-biased means includes a nut secured to said ratchet wheel, a washer slidably mounted on said bolt and abutting said ratchet wheel on a side opposite said nut, and a spring unit biasing said nut against said ratchet wheel and said washer to impose a friction force on said ratchet wheel sufficient to engage said ratchet wheel with said bolt.

7. An umbrella frame as set forth in claim 6 wherein said friction force is at least equal to a force imposed on said cord by said ribs tending to collapse inwardly under gravity towards said pole from an outwardly splayed position.

8. An umbrella frame as set forth in claim 6 wherein said spring unit includes a grommet mounted in said pole on a side opposite said ratchet wheel, a washer disposed about said bolt and abutted against said crank arm, and a compression spring about said bolt and compressed between said grommet and said washer to bias said bolt and not in a direction to press said nut against said ratchet wheel.

9. An umbrella frame as set forth in claim 6 which further comprises a housing having a first half-piece slidably mounted on said crank arm and a second half-piece disposed on an opposite side of said pole and secured to said first half-piece to house said clutch assembly therein.

10. An umbrella frame as set forth in claim 1 which further comprises a stop on said pole for abutting said second yoke in said distal position.

11. An umbrella frame as set forth in claim 1 wherein said pole includes a lower portion, an upper portion and a tilt mechanism securing said portions together in one of a plurality of selected angular positions relative to each other.

12. An umbrella frame as set forth in claim 1 wherein said pole is hollow and has a slot in one side and said means for moving said second yoke includes a cord having one end engaging said second yoke and passing through said slot and a crank assembly engaging an opposite end of said cord to wind said cord thereon whereby winding of said cord onto said crank assembly pulls said second yoke from said remote position to said distal position.

13. An umbrella comprising a pole;

a yoke mounted on said pole;

a plurality of radially disposed ribs, each rib being pivotally connected at one end to said yoke to move between a collapsed position adjacent said pole and an outwardly splayed position relative to said pole; and a cover mounted at a central area on said pole and secured at a plurality of peripherally disposed points to said ribs, said cover being spaced from said ribs between said points and said central area in said outwardly splayed position of said ribs.

14. An umbrella as set forth in claim 13 wherein said yoke is movable along said pole between a raised position with said ribs in said collapsed position and a lowered position with said ribs in said outwardly splayed position.

15. An umbrella as set forth in claim 14 which further comprises a second yoke fixedly mounted on said pole below said movable yoke; and plurality of radially disposed struts, each strut being pivotally connected at one end to said second yoke and being pivotally connected at an opposite end to a respective one of said ribs; and means for moving said movable yoke along said pole from said raised position to said lowered position to effect movement of said ribs from said collapsed position to said outwardly splayed position.

16. An umbrella as set forth in claim 15 said means for moving said movable yoke includes a cord having one end engaging said movable yoke and a crank assembly engaging an opposite end of said cord to wind said cord thereon whereby winding of said cord onto said crank assembly pulls said movable yoke from said raised position to said lowered position to move said ribs from said collapsed position to said outwardly splayed position.

17. An umbrella as set forth in claim 13 wherein said pole includes a lower portion, an upper portion and a tilt mechanism securing said portions together in one of a plurality of selected angular positions relative to each other.

18. An umbrella as set forth in claim 13 wherein said cover is removably mounted at a central area on said pole and removably secured at said peripherally disposed points to said ribs.

19. An umbrella as set forth in claim 18 which further comprises a post projecting from one end of said pole and wherein said cover has a ring concentrically mounted on said post.

20. An umbrella as set forth in claim 19 which further comprises a pin extending from said post and a retaining knob removably mounted on said pin to retain said ring on said post.

21. An umbrella as set forth in claim 18 wherein each rib has a male snap fastener element at a free end and said cover has a female snap fastener element at each said point thereof removably engaged with a respective male snap fastener element.

* * * * *